United States Patent [19]

Chang

[11] Patent Number: 4,776,194

[45] Date of Patent: Oct. 11, 1988

[54] PIPE MILL

[76] Inventor: William J. H. Chang, 2673 Goldwood Dr., Rocky River, Ohio 44116

[21] Appl. No.: 820,418

[22] Filed: Jan. 17, 1986

Related U.S. Application Data

[63] Continuation-in-part of Ser. No. 690,939, Jan. 14, 1985, abandoned.

[51] Int. Cl.[4] ..... B21D 5/14; B21B 37/00

[52] U.S. Cl. ..... 72/12; 72/17; 72/179; 72/182; 72/52

[58] Field of Search ..... 72/181, 182, 178, 179, 72/176, 52, 12, 17; 228/147, 150, 17

[56] References Cited

U.S. PATENT DOCUMENTS

| | | | |
|---|---|---|---|
| 382,277 | 5/1888 | Stasch | 72/181 |
| 1,184,947 | 5/1916 | Gossett et al. | 72/181 |
| 1,673,787 | 6/1928 | Frahm et al. | 72/181 |
| 2,012,795 | 8/1935 | Park | 72/181 |
| 3,355,922 | 12/1967 | Utashiro et al. | 72/178 |
| 3,635,064 | 1/1972 | Chang | 72/181 |
| 3,855,834 | 12/1974 | Evans | 72/179 |
| 3,903,723 | 9/1975 | Colbath | 72/178 |
| 4,558,577 | 12/1985 | Trishevsky et al. | 72/182 |

FOREIGN PATENT DOCUMENTS

| | | | |
|---|---|---|---|
| 156633 | 3/1922 | United Kingdom | 72/182 |
| 717650 | 10/1954 | United Kingdom | 72/182 |

*Primary Examiner*—Daniel C. Crane

*Attorney, Agent, or Firm*—Renner, Otto, Boisselle & Sklar

[57] ABSTRACT

A pipe mill and method comprises certain improvements in pipe mills of cage-type. Edge forming roll sets, usually mounted immediately downstream of the breakdown passes, are mounted for lateral movement to compensate for strip camber or lateral creep. In one form of the invention the edge forming rolls are adjustably fixed with respect to each other on a mounting plate which is suspended on a pivot. Movement of the edge forming rolls from side-to-side about the pivot is obtained by power steering each edge forming roll housing with the steering pivot located at the center of pressure of the edge forming roll set. The steering is controlled by a closed loop system utilizing sensors with a microprocessor. A taper pin lock holds the plate centered and against movement for threading purposes. Side push cylinder assemblies may be employed to center the plate for locking. In another somewhat more sophisticated form primarily intended for lighter gauge strip, the movement of the plate is further assisted by a double acting hydraulic cylinder controlled by the same closed loop automatic control system which may include three or more sensors, at least one detecting speed, and at least two lateral motion or presence of camber in the strip. In another aspect of the invention the breakdown passes and/or the edge forming roll sets may be mounted for slight angular adjustment from vertical to accommodate typical downhill or atypical uphill forming. Such breakdown passes may also be steered to compensate for camber utilizing the same or similar closed loop control system, either by pivoting about the vertical center axis or by controlling the side-to-side gap or pinch points of the breakdown.

21 Claims, 8 Drawing Sheets

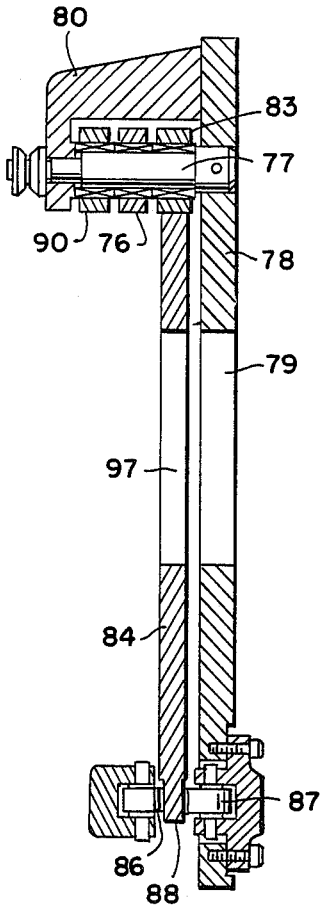
FIG. 3
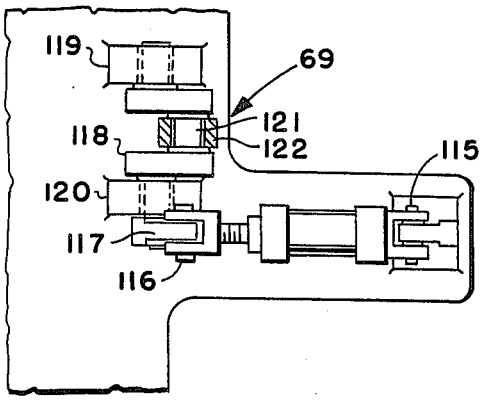
FIG. 5
FIG. 13
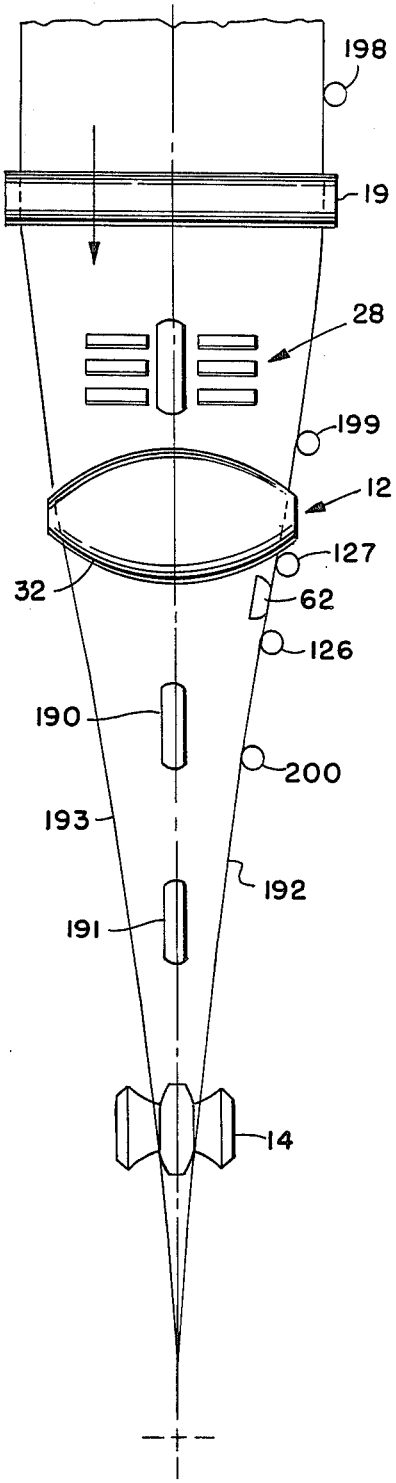

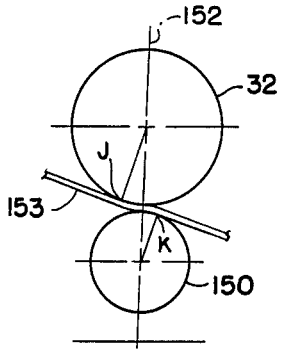
PRIOR ART
FIG. 8
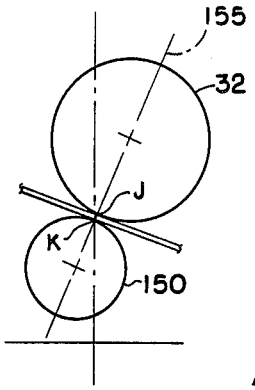
FIG. 9
FIG. 11
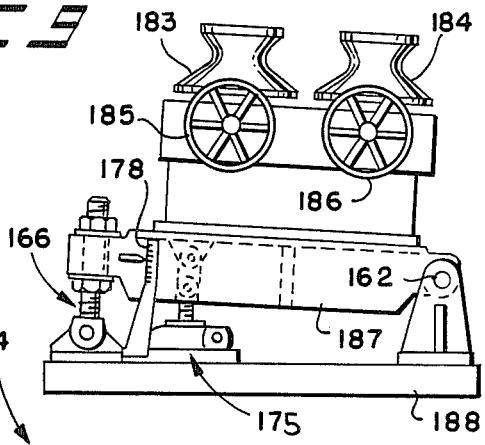
FIG. 10
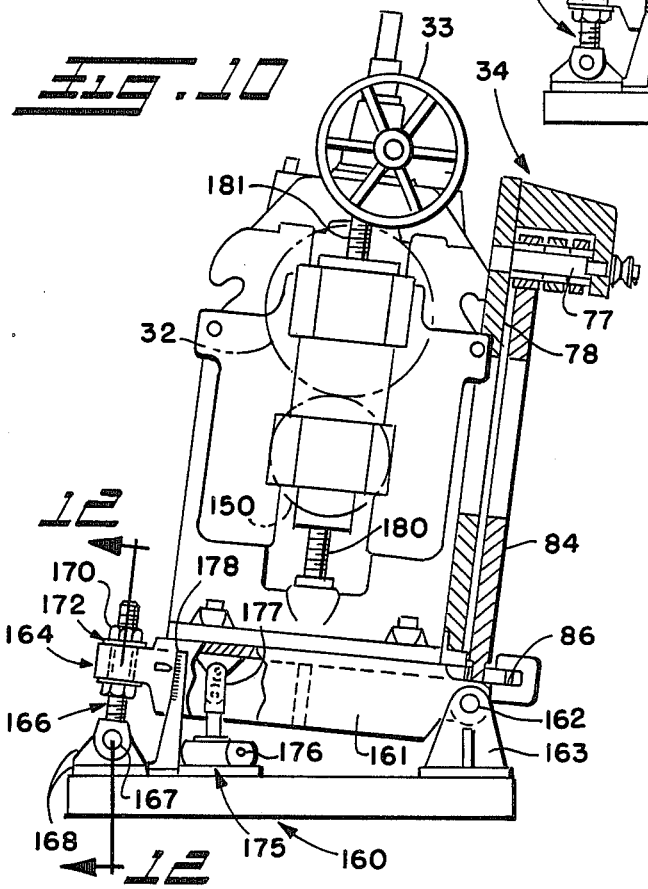
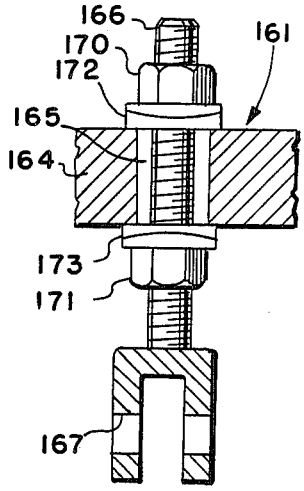
FIG. 12

PIPE MILL

RELATED APPLICATION

This application is a continuation-in-part of applicant's co-pending application Ser. No. 690,939, filed Jan. 14, 1985, entitled "Pipe Mill and Method", now abandoned.

This invention relates generally as indicated to a pipe mill and method and more particularly to certain improvements in a pipe or tube mill of the cage type.

BACKGROUND OF THE INVENTION

The present invention relates to certain improvements in pipe or tube mills of the cage type such as shown in applicant's prior U.S. Pat. Nos. 3,323,341; 3,472,053; and 3,635,064. In such tube or pipe mills, the edge forming is usually applied to the strip as part of or immediately downstream of the main forming roll passes which are commonly called breakown passes. However, when the strip which is being formed into the tube or pipe begins to creep in a lateral direction or a direction perpendicular to the general flow of the strip, an uneven amount of edge forming may result. If the inboard and outboard edges are formed unequally, a poor seam weld will develop. In a high speed mill, this may not be detected until substantial substandard or scrap product is produced. Accordingly, any creep of the strip toward the inboard or outboard side of the mill may cause the two edges of the strip to be formed unevenly and sometimes one edge of the strip may creep out of the edge forming roll and not be edge formed at all. This, of course, results in either no weld seam at all or certainly a defective weld seam.

The causes of the strip creeping are many. For example, improper setting and improper roll contours are common causes of creeping, although they can be controlled. Sometimes uneven thickness of the strip at the two edges may initiate creeping. Most often the cause is the camber of the strip. By camber of the strip, it is meant that although the lateral edges of the strip may be of uniform width, they deviate symmetrically from the normal center line of the strip.

Also, in recent years, the demand for welded tubular goods tends toward tubes of lighter and lighter wall thickness on the one hand and heavier wall thickness on the other hand. At the same time, the material being rolled is stronger in yield strength. As a result, the function of edge forming becomes increasingly important and critical. Therefore, the purpose of the invention is to provide uniform and true edge forming regardless of the creeping of the strip or the conditions which may affect uniform and true edge forming.

It is also the purpose of the present invention to provide a strip edge monitoring and tracking control system to ensure properly formed edges regardless of camber or other problems noted.

Another problem in pipe and tube mills of the cage type is that the breakdown passes which normally also support the edge forming roll sets also stand in a straight vertical plane perpendicular to the horizontal plane which is defined by the mill floor. Frequently, in such mills the strip extends in a downhill flow from flat to the final tubular or circular form. Somewhat infrequently, the pass may be uphill. Typically, the amount of downhill could be one to two diameters of the pipe. If the breakdown rolls or the edge forming rolls are in a plane vertical to the mill floor, the pressure between the rolls developed may not be enough to do any significant forming. If, however, the top and the bottom rolls are pressed together harder, an unwanted bending or cold forming of the strip develops. In this case the strip is subjected to some unnecessary and harmful stress and strain, and often results in poor forming and welding of the tube, higher energy consumption, and greater stress on the mill components. Thus, if the breakdown roll stands or the edge forming roll stands can be tilted to be at the proper angle with regard to the uphill or downhill movement of the strip, such problems will not occur.

SUMMARY OF THE INVENTION

With the present invention there is provided a pipe or tube mill and method which comprises certain improvements in pipe or tube mills of the cage-type. One aspect of the invention uses edge forming roll sets, usually mounted immediately downstream of the breakdown passes, which are mounted for floating lateral movement to compensate for strip camber or lateral creep. In one form of the invention the edge forming rolls are adjustably fixed with respect to each other on a mounting plate which is suspended on a pivot. Two strip edge engaging roller sets, each individually steerable, move the plate and thus the edge forming roll sets back and forth as dictated by the lateral movement of strip edges. Movement of the edge forming rolls from side-to-side about the pivot is obtained by power steering each edge forming roll housing with the steering pivot located at the center of pressure of the edge forming roll set. The steering is controlled by a closed loop system utilizing sensors with a microprocessor. A taper pin lock holds the plate centered and against movement for threading purposes. Side push cylinder assemblies may be employed to center the plate for locking.

In another somewhat more sophisticated form, primarily intended for lighter gauge strip, the movement of the mounting plate is further assisted by a double acting hydraulic cylinder controlled by the same closed loop automatic control system which includes at least three sensors, at least one detecting speed, and at least two lateral motion or presence of camber in the strip.

In another aspect of the invention the breakdown passes and/or the edge forming roll sets may be mounted for slight angular adjustment from vertical to accommodate typical downhill or atypical uphill forming. Such breakdown passes may also be steered to compensate for camber utilizing the same or similar closed loop control system, either by pivoting about the vertical center axis or by controlling the side-to-side gap or pinch points of the breakdown. In this manner the strip travel is controlled despite the presence of camber or other creeping factors, and also the unwanted bending or cold working of the strip is avoided thus resulting in improved weld integrity, superior dimensional tolerances, and lower energy consumption.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In said annexed drawings:

FIG. 3 is a fragmentary generally vertical section taken from line 3—3 of FIG. 2;

FIG. 5 is a fragmentary side elevation taken from the line 5—5 of FIG. 4 illustrating the power steering cylinder assembly and the turnbuckle drive connecting it to the roll set housing;

FIGS. 8 and 9 are schematic illustrations comparing the prior art and one aspect of the present invention, respectively, in a downhill pass;

FIG. 10 is an enlarged side elevation taken from the line 10—10 of FIG. 1 illustrating a tiltable breakdown stand;

FIG. 11 is a view similar to FIG. 10 but illustrating a tiltable idler roll stand;

FIG. 12 is an enlarged fragmentary vertical section taken approximately from the line 12—12 of FIG. 10;

FIG. 13 is a schematic top plan view of the whole mill illustrating the exemplary position of a number of sensors which may be used not only for the control of the edge forming rolls but also the steering of the other units of the mill;

DETAILED DESCRIPTION OF THE PREFERRED EMBODIMENT

Figure 1:
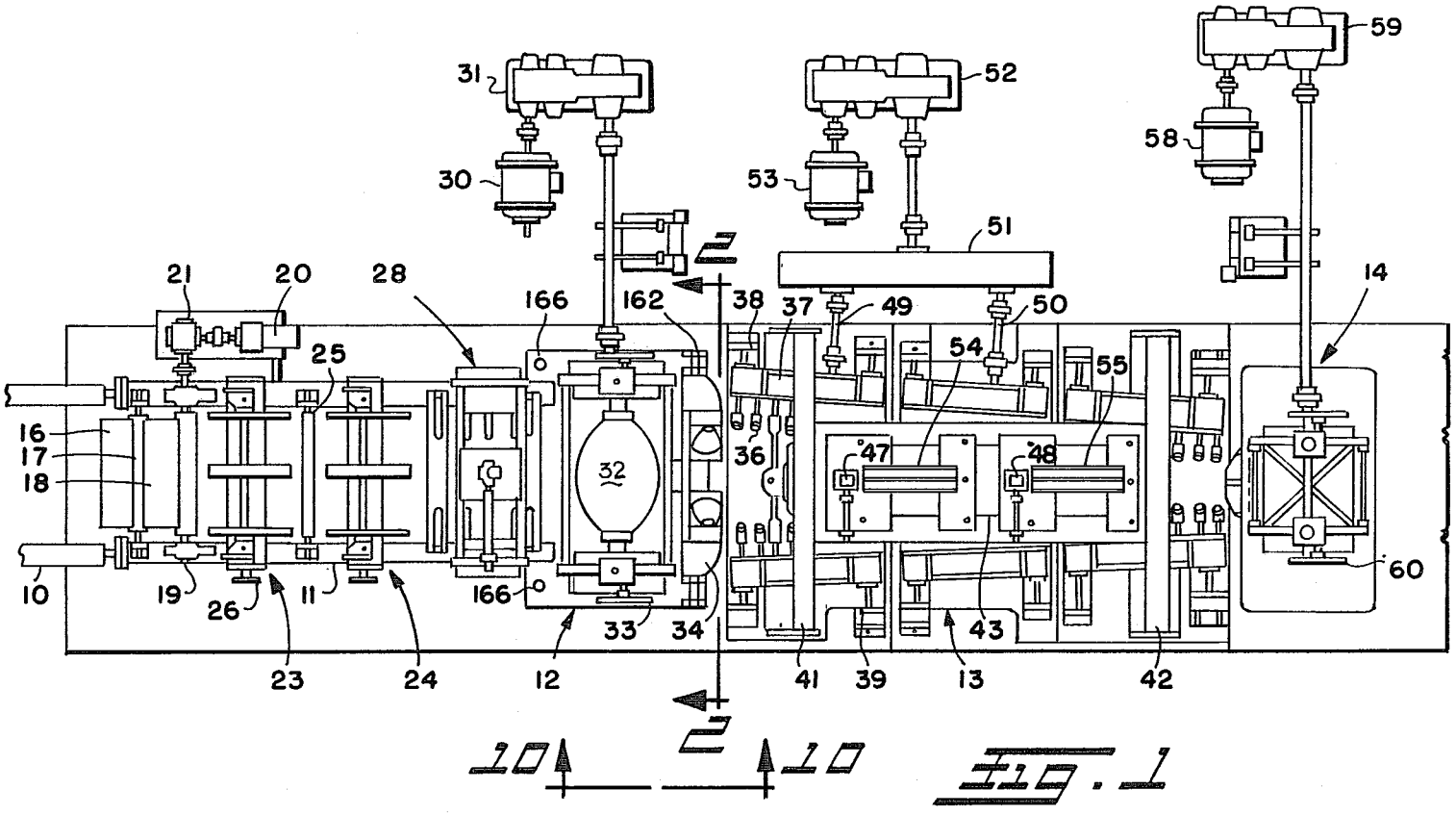
FIG. 1 is a top plan view of a mill in accordance with the present invention.

Referring first to FIG. 1 there is illustrated a top plan view of a pipe or tube mill in accordance with the present invention. It will be appreciated that the environmental view of FIG. 1 is merely one illustration of many forms or combinations of units which may form a pipe or tube mill in accordance with the present invention. In any event, it will be seen that the strip of metal enters from the left in FIG. 1 from entry conveyor 10 and moves onto the table of slightly downwardly inclined preformer conveyor 11. Such preformer conveyor centers or aligns the strip with the center line of the mill and conditions it with the preformer unit on the exit end thereof to pass into the initial breakdown shown generally at 12. From the initial breakdown, the strip passes into a cage roll assembly 13 which will substantially form the strip into circular shape. From the cage roll assembly the strip then passes into the initial fin pass shown generally at 14. There may be more than one breakdown and more than one fin pass. From the fin passes the strip passes into the welder and emerges as a pipe or tubing and is then severed into lengths for further processing.

From the entry conveyor 10, the strip passes over shelf 16, idler roll 17, shelf 18 and into the nip of pinch roll unit 19 which is driven by motor 20 through reducer 21. The shelves, idler roll and pinch roll unit are mounted at the entry end of the preformer conveyor 11. The strip then passes through edge guide units 23 and 24 separated by idler 25. The edge guide units may be adjusted through hand wheels seen at 26 to accommodate strip of different widths and in any event, to substantially align the strip with the centerline of the mill.

From the edge guide device 24, the strip passes into preforming unit 28 at the exit end of the preforming conveyor 11. Such preforming unit dishes the strip slightly beyond its yield point and enables the strip to move easily into the first breakdown 12. The initial breakdown rolls are driven by large drive motor 30 through reducer 31. The top roll is seen at 32 and the bottom roll has a mating female configuration. The top roll may be moved vertically by separate screw jacks for individual adjustment by separate hand wheels 33.

Mounted on the exit side of the initial breakdown 12 is an edge forming device shown generally at 34 which is operative to bend the lateral edges of the strip on a radius shorter than that of the main portion of the strip. This facilitates the final shaping of the strip into circular, tubular or pipe form. The edge forming device 34 and the initial breakdown are shown in greater detail in subsequent figures.

After passing through the initial breakdown and the edge forming assembly, the strip then passes into a cage roll assembly 13 which comprises a plurality of idler rolls 36 on beams 37 which are in turn each mounted on pairs of inclined stands 38 and 39 so that the beams may be adjustably positioned along such stands at each end. The stands extend transversely of the mill centerline and are symmetrically disposed. In the illustrated embodiment there are three beams and two stands for each beam on each side of the mill. In this manner the idler rolls 36 substantially follow the same longitudinal position on the strip as the strip is formed from the relatively shallow dish shape leaving the edge forming device to a substantially circular shape entering the fin passes 14.

Overhead bridge frames 41 and 42 support therebetween longitudinally extending frame 43. The frame 43 supports for vertical movement hold down rolls through adjustments indicated at 47 and 48, respectively, such hold down rolls forcing the strip against bottom driven rolls, not shown, driven from shafts 49 and 50 through transmission 51 from reducer 52 driven by drive motor 53.

The longitudinal top frame 43 also supports for vertical adjustment interior side roll cluster assemblies 54 and 55. For a more detailed disclosure of the cage roll assemblies reference may be had to applicant's prior U.S. Pat. Nos. 3,323,341; 3,472,053; and 3,635,064.

From the cage roll assemblies, the now substantially circularized strip passes into the initial fin pass 14, each roll of which may be power driven through drive motors 58 and reducers 59. The top roll of each pass may be vertically moved by adjustment of the hand wheel 60. As will be appreciated from the prior patents the circularized strip in tube or pipe form moves into the seam welder from the fin passes to be integrally formed and welded into pipe or tube.

Figure 2:
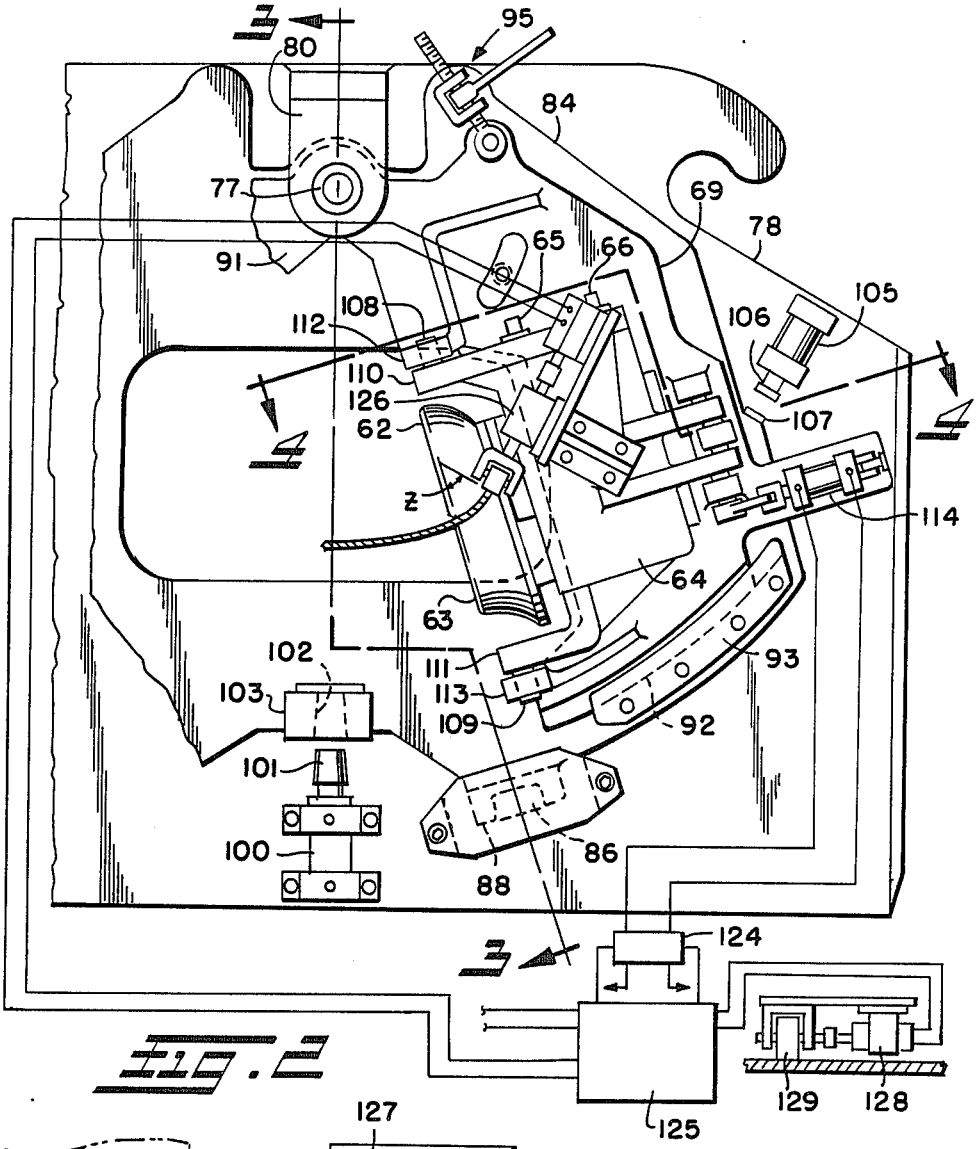
FIG. 2 is an enlarged fragmentary vertical section taken generally from the line 2—2 of FIG. 1 illustrating one form of floating edge forming roll assembly and also schematically the control system for the power steering of the roll sets.

Referring now to FIG. 2, there is illustrated one form of edge forming unit in accordance with the present invention. As can be seen from FIG. 2, the edge forming unit comprises two edge forming roll sets although the symmetrically positioned set on the left hand side of FIG. 2 is not illustrated. Each roll set includes a male or upper roll 62 and a lower or female roll 63. Such rolls are mounted on respective parallel shafts journalled in roll block housing 64. The top or male roll may be moved vertically to open and close the roll sets by the jack screws 65 and 66 on top of the housing. Reference may be had to applicant's prior U.S. Pat. No. 3,635,064 for a more detailed disclosure of the mounting and adjustment of the edge forming rolls within the housing.

Figure 4:
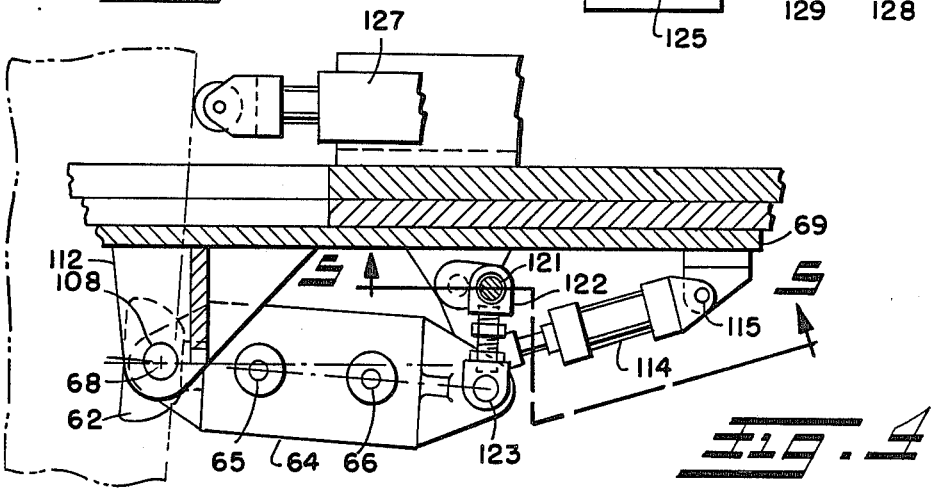
FIG. 4 is a fragmentary generally horizontal section taken from the line 4—4 of FIG. 2 but partially distorted from such line illustrating a roll set and an upstream strip edge sensor.

As indicated more clearly in FIG. 4, the housing 64 is pivotally mounted on axis 68 on plate 69. The plate or bracket 69 for the right hand roll set seen in FIG. 2 includes a hub 76 at its upper end which is journaled preferably by tapered roller bearings on pivot pin 77 as shown in FIG. 3. The pivot pin is mounted on and projects downstream of fixed mounting plate 78. The fixed mounting plate is adjustable vertically as seen in prior U.S. Pat. No. 3,635,064 and can be locked in on the exit side of the breakdown 12. The fixed mounting plate includes a window 79 and at the top a downstream projecting bracket 80 including a downturned front wall 81 which assists in supporting the pivot 77.

Also journaled on the pivot 77 is hub 83 of floating mounting plate 84. The floating mounting plate is substantially adjacent to the fixed mounting plate and is supported for swinging movement about the pivot between anti-friction roller assemblies 86 and 87 each mounted on the fixed mounting plate. The floating mounting plate is provided with surface finished ears 88 which are captured and engaged by the opposed rollers to maintain the plate parallel to the fixed mounting plate. It will be appreciated that there are two such ears symmetrically disposed on each side of a vertical plane through the centerline of the mill. Also journaled on the pivot 77 is hub 90 of plate or bracket 91 for the opposite roll set. It is noted that the plates 69 and 91 are confined at their lower arcuate finished edges 92 by gibs 93 mounted on the lower edges of the floating plate 84. The plates or brackets for the respective roll sets are positionally adjustably controlled about the pivot 77 by releasable screw adjustments 95 which interconnect the roll plate brackets and the floating plate. In this manner the lateral position of the roll sets may be adjusted for the size of pipe being rolled. If one or the other of the screw adjustments are released, it will be appreciated that the roll sets on each side of the strip will move independently, rather than in unison.

It can now be seen that the floating plate to which roll sets are adjustably secured is mounted for limited floating or oscillating movement to the left and right as seen in FIG. 2 about the pivot 77 and that such plate is confined by both the pivot and the anti-friction rollers of the roll sets 86 and 87. The floating plate also has a window generally corresponding to the window 79 in the fixed plate 78 as seen at 97.

At the lower center of the fixed plate there is provided a hydraulic double-acting piston-cylinder assembly 100 which reciprocates a taper shot pin 101 which when extended engages tapered opening 102 in hub 103 secured to the floating plate. When retracted, the shot pin clears the plate.

In order to center the floating plate for engagement of the shot pin, there is provided two symmetrically disposed side-push piston-cylinder assemblies 105 which are mounted on the fixed plate 78. When extended, the rods 106 thereof will engage shoulders 107 on the floating plate insuring that the plate is properly centered so that the shot pin 101 may be extended, thus locking the plate against floating movement. Piston rods 106 are generally retracted as soon as the taper shot pin 101 is securely locked in tapered opening 102. The side push piston-cylinder assemblies and the locking pin may be used only for strip threading purposes.

Reverting now to FIGS. 2, 4 and 5, it will be seen that the axis 68 forms a steering pivot for the roll set and that the steering pivot is located at the center of pressure of the edge forming rolls 62 and 63. The steering pivot is formed by pivot pins 108 and 109 interconnecting yoke arms 110 and 111 projecting from the front end of the housing 64 and ears 112 and 113 projecting from the plate bracket 69.

Power steering of the roll housing about the steering pivot axis 68 is obtained by a double acting hydraulic piston cylinder assembly seen at 114. The blind end of the steering cylinder assembly 114 is pivoted at 115 to the bracket 69 while the rod is pivoted at 116 to the outer end of a lever 117 mounted on the lower end of crank shaft 118 journaled in pillow blocks 119 and 120 mounted on the face of the bracket 69. The crank shaft includes an offset portion 121 to which is connected one end of adjustable link 122, with the opposite end being pivoted at 123 to the end of the roll housing 64 opposite the steering pivot.

The adjustable link 122 functions like a turnbuckle and is provided to set the edge forming roll housing so that its roll shaft centerline (normal to the steering pivot axis) is perpendicular to the strip edge at the location where the edge forming rolls are in contact with the strip.

As indicated in FIG. 2 the piston cylinder assembly 114 for power steering the roll set 62, 63 is actuated by a valve 124 in turn controlled by a microprocessor 125. Various sensors feed information to the microprocessor. For a given roll set the sensors comprise at least three, at least two of the three being edge position sensors, one indicated at 126 being downstream of the roll set and one indicated at 127 being upstream of the roll set. It is noted that the camber measuring device or sensor 127 seen in FIG. 4 is not shown in its true plan since the roller edge contact thereof will engage the edge of the strip which has curled to a configuration approximating that seen in FIG. 2.

A third sensor 128 is in the form of a tachometer generator driven by roller 129 in engagement with the strip. The sensor measures the speed of the strip and the microprocessor integrates that information with the various position or camber detecting sensors. As will hereinafter be described, there may be a number of position or camber detecting sensors positioned throughout the mill while there normally need by only one speed sensor.

Figure 6:
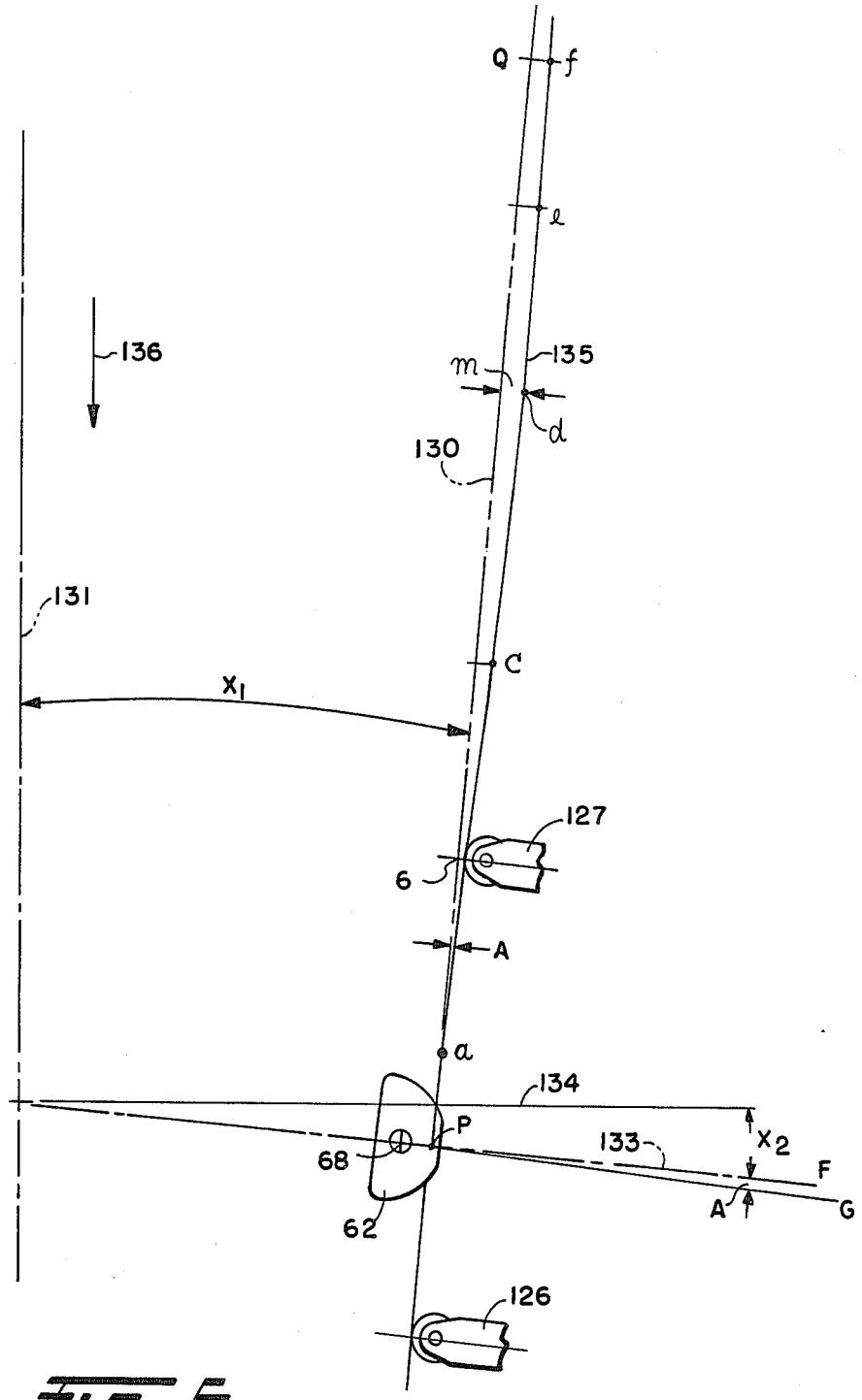
FIG. 6 is a schematic illustration of one edge of the strip and the sensors on each side of a roll set.

Referring now to FIG. 6, there is one well-defined strip edge line indicated at 130 for each pipe size, assuming the strip is camber free. The angle X1 between such strip edge and the centerline 131 of the mill varies only slightly from the maximum pipe size to the minimum pipe size for a given pipe mill. Although the variations of the angle X1 are not great, yet it is of prime importance that the shafts of the roll set be perpendicular to the strip edge for all pipe sizes as indicated by the centerline 133 of the roll housing. In applicant's prior U.S. Pat. Nos. 3,472,053 and 3,635,064, the edge forming roll shafts are mounted perpendicular to the centerline of the mill all the time for all the pipe sizes without adjustability. This has been found to generate unnecessary strip bending, especially for large pipe sizes, resulting in unwanted stress, strain and roll marks on the strip and energy loss. With the present invention, for any given pipe size, the angle X2 between the roll housing centerline 133 and the reference line 134, which is normal to the mill centerline 131, can be adjusted to be equal to the angle X1. This is of course accomplished through the turnbuckle or adjustable length link 122.

For a given pipe size, once the angle X1 is set in the beginning of the run, it will not change unless the strip is creeping transversely due to strip camber or other reasons. The creeping produces a minute amount of angular deviation from the correct angle X1. The line 135 indicates the strip edge with camber exaggerated for clarity. In a short moment, the amount of edge forming of the two sides of the strip becomes not uniform. That is, the angle Z (seen in FIG. 2) which is the extent of curvature being formed by the roll set on the right side of the centerline of the mill increases if the camber of the right side of the strip is convex, while the angle Z on the left side of the strip decreases because the camber on the left is consequently concave by nature since the strip width is uniform.

It will be appreciated with the power steering of the present invention and through the use of the linear sensors and the microprocessor as arranged in this invention, the angle X2 may be altered instantly to match the angle of the actual strip edge which is X1+A at any moment. The microprocessor 125 controlling the valve 124 causes the power steering piston-cylinder assembly 114 to rotate the crank shaft, which through the adjustable connecting link, rotates the edge forming roll housings about the steering pivot axis 68. It will of course be appreciated that there is a companion steering cylinder and valve located on the left side of the centerline of the mill and that for each side of the strip, there is another camber measuring sensor mounted upstream and at the immediate vicinity of the edge forming rolls. It will also of course be appreciated that the linear movement sensors are mounted for movement from an extended to a retracted position and thus may quickly be withdrawn so that when one coil of strip is depleted, the sensor assemblies are retracted, thus being protected from damage by the leading end of the moving strip from the next coil as it is being threaded through the mill.

Referring again to FIG. 6 it will be noted that with the above described steering mechanism for the roll sets on each side of the mill which are adjustably fixedly spaced, but which can float back and forth with respect to the centerline 131 of the mill about the pivot 77, can readily compensate for such camber. The advancing strip moving in the direction of the arrow 136 parallel to the centerline 131 of the mill, normally does not have any transverse movement in spite of the presence of camber. Assuming there is convex camber to the right, as seen in FIG. 6, then camber appears as if the strip width is growing at the right, and shrinking at the left. Without the provision of the steering, at the right edge of the strip, the angle Z is increasing while it is decreasing at the left edge of the strip. The edge forming rolls are not driven by any electric or hydraulic motor. They are simply idlers but forced to rotate by the action of the traveling strip. Due to the positive pinching action between the top and the bottom rolls on the strip, there is no relative transverse movement possible between the rolls and the strip. In order to swing the right edge forming bracket (which is free to swing because it is mounted on the floating mounting plate) it is only necessary to steer the edge forming roll housing with a minute angle in the proper direction.

A lateral component or vector generated by the advancing strip in conjunction with the slightly oblique roll housing will cause the right edge forming bracket 69 to swing up, or counterclockwise about the pivot 77, thus maintaining a substantially constant angle Z compensating for the growth of the right hand side half strip width. It will also be appreciated that a lateral component or vector generated by the advancing strip in conjunction with the slightly oblique opposite roll housing will cause the left edge forming bracket 91 to swing counterclockwise about the pivot 77, thus maintaining a substantially constant angle Z compensating for the diminishment of the left hand side half strip width. This control of the angle Z on both sides of the strip is further ensured by the fact that the right and left hand forming brackets 69 and 91 are tied together for movement in unison to the floating plate 84.

As indicated in FIG. 6, the straight line 130 represents the neutral or no camber line for the right hand edge of the strip. The line 135 represents the strip camber somewhat exaggerated.

Line PaQ represents the neutral or no camber line, on which, part of the strip edge Pa lies. This means that the Pa portion of the strip edge Pa b c d e f has no camber. Since at this moment, there is no camber, the center line of the edge forming roll housing PF should be perpendicular to PaQ and the steering cylinder is not signaled to take any action.

The upstream linear sensor 127 senses the amount of camber for every small increment, i.e. one inch or less, of the strip passing by. The microprocessor then calculates the rate of change per increment of the advancing strip. If the increments are small enough (say every half inch) the calculated values represent the slopes of the various points on the strip edge Pa b c d e f. The microprocessor then retains the slope values and their locations of every half inch of the traveling strip and calculates the time required for the respective points to arrive at the edge forming rolls.

If angle A is the slope of the strip edge at point a as calculated and recorded by the microprocessor, when point a approaches point P, the steering cylinder will be signaled to swing the roll housing clockwise as seen in FIG. 6 through the additional angle A. In this manner the center line of the edge forming roll housing will take the position of the line PG and become perpendicular to the slope of point a when such point reaches the point P. The slope of the various points on the strip edge are different. From point a to point c, the slope is increasing; from point c to point d, the slope is decreasing. The slope at point d is parallel to that of point P. Thus, when point d reaches the edge forming rolls, the roll shafts will line up with the line PF again. However, by that time, the whole floating mounting plate has swung enough to the right to take up the excess amount of strip width m equivalent to the distance between the point d to the neutral or no camber line.

The linear sensor mounted at the exit of the edge forming rolls measures the amount of edge forming at the right side of the strip, and may be used primarily to compare that value to a similar value for the left hand side of the strip. If they are not equal, the information is fed back to the microprocessor to cause the two steering cylinders to adjust with respect to each other so that the edge forming variances between the left and right hand sides of the strip do not enlarge but diminish to a negligible amount.

In FIG. 2 there is described a floating mounting plate assembly which will swing to the proper angle to maintain uniform edge forming. The driving force to swing the assembly comes primarily from the traveling strip through the grip of the top and bottom edge forming rolls on the strip. The lateral vectors or components derived from the advancing strip are generated by steering the edge forming roll housings. Control is provided by the microprocessor using information of the magnitude and location of the camber plus the speed of the traveling strip. This arrangement works well for heavy or medium gauge strip. However, for light gauge strip, the grip may not be sufficient for the relatively massive assembly.

Figure 7:
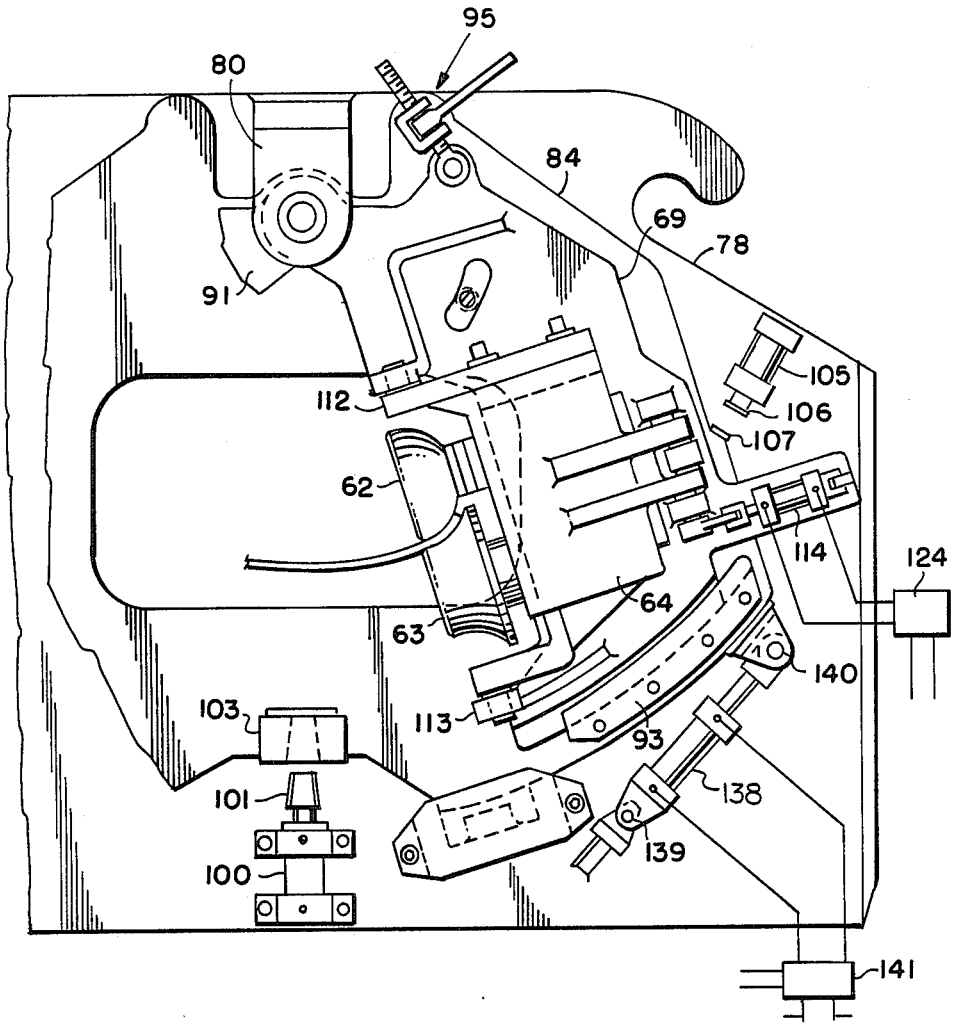
FIG. 7 is a view similar to FIG. 2 illustrating the floating plate controlled for lateral or swinging movement by a double acting hydraulic cylinder through the same microprocessor.

As seen in FIG. 7, in order to overcome this problem, there is provided a double acting hydraulic piston cylinder assembly 138. The piston cylinder assembly may be mounted on the right side of the fixed mounting plate as indicated at 139 with the clevis end of the rod connected to the bottom edge of the floating mounting bracket as indicated at 140. The double acting swing piston cylinder assembly 138 is controlled by valve 141 which is also connected to the same microprocessor 125 seen in FIG. 2. The information required to operate the swing cylinder assembly 138 is the same as that needed to operate the steering cylinders, namely, the magnitude and location of camber plus the speed of the traveling strip. The only difference is the mechanical proportionality of the structure.

It will be appreciated that the function of the swing cylinder assembly is not meant to overpower the steering cylinders and that the former is only to assist the latter in a synchronized manner so that the light gauge strip would not bear an excessive burden or cause a slippage between the edge forming rolls and the light gauge strip.

It will be appreciated that the embodiments of FIGS. 2 and 7 are essentially the same except for the presence of the power swing cylinder assembly 138 and its control through the valve 141 from the microprocessor. Accordingly, the edge forming roll assembly may readily operate in either of the two modes, and for heavy and medium strip, the swing piston-cylinder assembly 138 may readily be disconnected. The microprocessor may easily be set for either mode.

Referring now to FIGS. 8–12 there are illustrated certain additional improvements. However, referring first to FIGS. 8 and 9, and initially to FIG. 8, it will be seen that downhill forming in a pipe mill which is fairly common, creates certain problems. Downhill forming reduces elongation of the strip edge and stress on the edge. Downhill forming is normally obtained simply by elevating the rolls in the early breakdown stands or other equipment so that the centerline of the pipe or stock progresses downhill from the flat condition to the circular form. The amount of downhill may be, for example, from one to two diameters of the pipe. FIG. 8 simply shows a cross-section through a conventional breakdown stand in a downhill forming mill with the downhill grade being somewhat exaggerated. The upper male roll is shown on top while the female roll on the bottom. Such rolls are normally vertically aligned on the axis 152. If the strip is to follow a natural intended downhill curve, indicated by the strip 153, the contact points between the strip and the rolls may be far apart unless full pressure is applied. If insufficient pressure is applied there will not be enough pressure developed between the rolls and the strip to do any forming. If, however, the top and bottom rolls are pressed together as indicated in FIG. 8, unwanted bending of the strip develops between the points J and K as indicated. In this case, the strip is subjected to some unnecessary and harmful stress and strain, and such often results in poor forming, increased energy consumption, and higher stress on the mill components.

To solve this problem, a tilted mill stand is provided as shown in FIG. 9, schematically. In this manner, the axis indicated at 155 through the axis of the upper and lower rolls is tilted forwardly or leaning downstream. In this manner, the distance between the points j and k is greatly reduced to its minimum which is the thickness of the metal and the points J and K are in line with 155, therefore the unwanted bending or stress is avoided with accompanying reduction in the energy or horsepower requirements of the mill.

There is, of course, the added advantage of tilting the breakdown stand in tilting the edge forming unit which is attached thereto. Therefore, the edge forming unit now enjoys the same benefits as that of the breakdown stand to which it is attached. In this manner the strip passing through the edge forming roll sets of the breakdown stand do not require additional bending or stress and energy requirements are reduced.

In order to tilt the breakdown stand the several degrees required to achieve the avoidance of unwanted strip bending and stresses, the breakdown stand seen in FIG. 10 is provided with a base 160 and sub-base 161. The sub-base is mounted on the base by two hinge pins indicated at 162 on the right-hand side of FIG. 10, which hinge pins are supported above the base on clevis-type brackets 163. The opposite end of the sub-base 161 is provided with ears 164 in which are provided elongated slots or openings 165. Extending through such openings are clamping eye bolts 166, the lower ends of which are pivoted at 167 to brackets 168 mounted on the base 160. Such clamping bolts extend through such elongated holes and are secured to the sub-base by lock nuts 170 and 171 bearing against spherical washers 172 and 173, respectively, as seen in FIG. 12.

Angular adjustment of the sub-base about the pivot 162 is obtained by jacks 175 concurrently operative by line shaft 176. The top of each jack is connected to the sub-base through link 177. A scale 178 indicates to the millwright the extent of angular adjustment. In operation, the lock nuts 170 and 171 will be loosened, and the angular adjustment will be made through the jacks 175. When in the proper position as indicated by the scale, the lock nuts will be tightened. The bottom roll 150 may be adjusted by jack screw 180 while the top roll 32 is adjusted by the jack screws 181 through the hand wheels 33. In any event, the breakdown stand may be brought to the desired angular inclination by such adjusment.

As seen in FIG. 11, a similar mechanism may be employed to mount idler roll assemblies 183 and 184 which are width adjustable by hand wheels 185 and 186, respectively. Such idler roll assemblies may be mounted on a sub-base 187 which is in turn mounted on a fixed base 188 for angular adjustment in the same manner as shown in FIG. 10.

It can readily be seen that an added advantage of tilting the breakdown stand also involves tilting of the edge forming roll assembly mounted thereon and that the benefits of both result.

On some occasions, where edge tension is needed, an uphill pass may be employed. In that case, the stands may be simply reversed, i.e., lifted from their mountings and turned 180°. In this manner they may be tilted upstream to accommodate an uphill forming system.

The present invention also incorporates certain improvements for monitoring and controlling the uniformity of edge forming and the stability of welding seam orientation by monitoring and controlling of the strip movement in the front part of the forming section, generally from the preforming conveyor through the number one breakdown, the edge forming unit and the number two breakdown. Referring now to FIG. 13 there is shown a pictorial top view of the traveling strip passing through the main components of the forming section of a typical cage mill. The components from the top to bottom in such view are the pinch rolls 19, the preformer 28, the number one breakdown 32, the edge forming roll units shown at 62, the number two breakdown 190, the number three breakdown 191, and the initial fin pass 14. The right hand curve 192 represents the edge of the traveling strip viewed from the top while the left hand edge is shown at 193. It will be appreciated that in transverse section the strip is moving from a flat condition at the top to a slowly closing inverted C or circular shape at the bottom with the joined edges forming the seam of the pipe or tube which is to be welded.

Normally, the movement of the strip edge is very stable unless there is camber or uneven thickness in the strip or improper roll setting. The main fully contoured driven rolls are the rolls 32 and 150 at the number one breakdown, which rolls have the most influence on the tracking of strip movement. Lateral creeping of the strip will develop if the strip is of uneven thickness passing through the number one breakdown or if the number one breakdown rolls are not set properly. The floating edge forming of this invention will compensate for the creeping regardless of what are the sources of such creeping. However, the floating steerable edge forming roll sets are designed to handle a normal amount of camber which usually reverses itself in direction and will not deviate too greatly from the neutral line.

However, if the creeping is due to the uneven strip thickness and the unevenness is one-sided all the time rather than at random, or the number one breakdown roll gap is wider at one side than the other, or that the driving or pinch points on the left and on the right sides of the rolls are not symmetrical, then the strip may creep beyond what is normal for camber. Such lateral movment may continue in one direction for too long causing damage in the strip and the mill equipment. The purpose of this portion of applicant's invention is to monitor and detect the nature of the strip creeping, impose some control, and to provide early warning or to stop the mill before such damage might be done.

Again referring to FIG. 13 it will be seen that a number of edge sensors are provided. The initial sensor 198 is located at a point where the strip is still flat. The next sensor 199 is at the entry side of the number one breakdown pass. The next sensor is the sensor 127 at the exit of the number one breakdown but prior to the edge forming roll sets. The next sensor is the sensor 126 located immediately after the edge forming roll sets, and the final sensor 200 is located after the number two breakdown pass which is really only a propelling station. All the position sensors indicated feed information to the central microprocessor 125 and enable that microprocessor to determine essentially instantaneously whether a strip has only a normal camber or if the number one breakdown is functioning improperly. If the latter is the case, the microprocessor then sends a signal to adjust the roll of the breakdown pass. If the strip creeping reaches a dangerous degree, beyond a simple adjustment of the roll, a warning signal may be given to the mill operator or the mill may be automatically stopped.

For example, if the initial sensor 198 detects at such point that the strip has one-half inch camber to the left, it may be monitored by the sensor as a plus one-half. The strip then travels with a speed, for example, of 20 inches per second (as measured by the strip speed sensor not shown in FIG. 13) and the distance between the initial sensor 198 and the sensor 199 is, for example 180 inches. Therefore, in nine seconds the strip edge reaches the point of the second sensor 199. If sensor 199 at such point measures the camber at this moment to be also plus one-half inch, then most likely, the preformer rolls have not caused any creeping. Likewise, when the same point reaches the sensor 127, and if the reading of that sensor still remains plus one-half, then the microprocessor will be satisfied and no signal will be given.

If, however, the reading at sensor 127 is plus three-quarters, for example, then it may be derived that the number one breakdown roll pass has caused a lateral movement of one-quarter of an inch to the left. Then, in the most simple form of the invention, a red light or horn alarm may be given and the adjustment screws of the number one breakdown top roll assembly may be actuated to increase the roll gap at the left hand side of the mill housing.

Since the microprocessor 125 can store an immense amount of data, group that data, and analyze it with essentially instantaneous speed, with the sensors strategically positioned as indicated, the operator may learn the dynamics of strip lateral movement in great detail. The system may not only display at any instant the camber readings of the various points of the entire strip section that is in the forming area, but also display the camber readings of any specific point of the strip. The comparison of the readings, for example, may reveal what the number one breakdown, the edge forming unit and the number two breakdown have each separately done to strip creeping. The system may use logic and pinpoint the source of the problems and give warning if necessary. With the present invention the system may also be used automatically to adjust the number one breakdown top roll as seen in FIG. 14.

While automatic control is illustrated applied to the number one breakdown, it will be appreciated that similar automatic controls may be provided to the preformer, and the number two and number three breakdowns, all being linked to the microprocessor of the automatic system.

Figure 14:
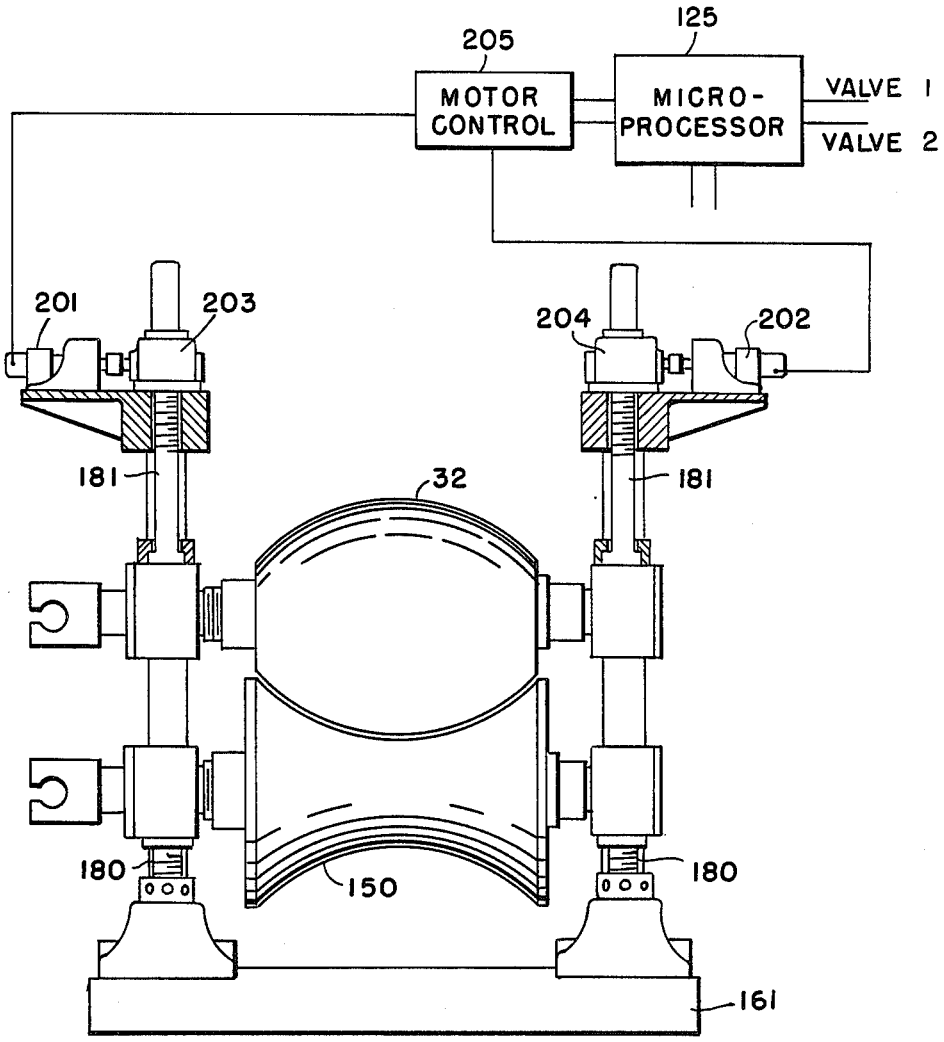
FIG. 14 is a front elevation partially in section of one form of the number one breakdown which may be power adjusted from the microprocessor to steer the strip therethrough.

As illustrated in FIG. 14, the bottom roll 150 is shown mounted on the base 161 with the noted separate manual adjusting screws 180. The bottom roll is normally set level. The top roll adjusting screws are separately adjustable by two electric motors shown at 201 and 202 which drive through reducers worm gear sets 203 and 204, respectively, controlling the elevation of the jackscrews 181. The control of the reversible electric motors is through motor control 205 which is in turn controlled by the microprocessor 125. If the microprocessor detects any strip creeping which is caused by poor tracking of the number one breakdown rolls, then one of the motors will be signaled to adjust a minute amount until the tracking functions are within a practical reasonable range.

In general, the profile of the number one breakdown rolls has three different styles. In the first style the contour of the top and bottom rolls are concentric whereby the gaps between the two rolls are constant everywhere. In the second style the profile radius of the bottom roll is greater than that of the top roll by more than the maximum gauge of the strip. In the third style there are only two points of contact between the rolls and the strip of any gauge. These are called pinch points or roll driving points. The two driving points, one at the left and one at the right, are located symmetrically somewhere between the center line of the rolls and the edge of the rolls. Regardless of which style of roll profile is used, the strip tracking direction may be laterally shifted by raising or lowering one end of the roll shaft by a slight amount.

Figure 16:
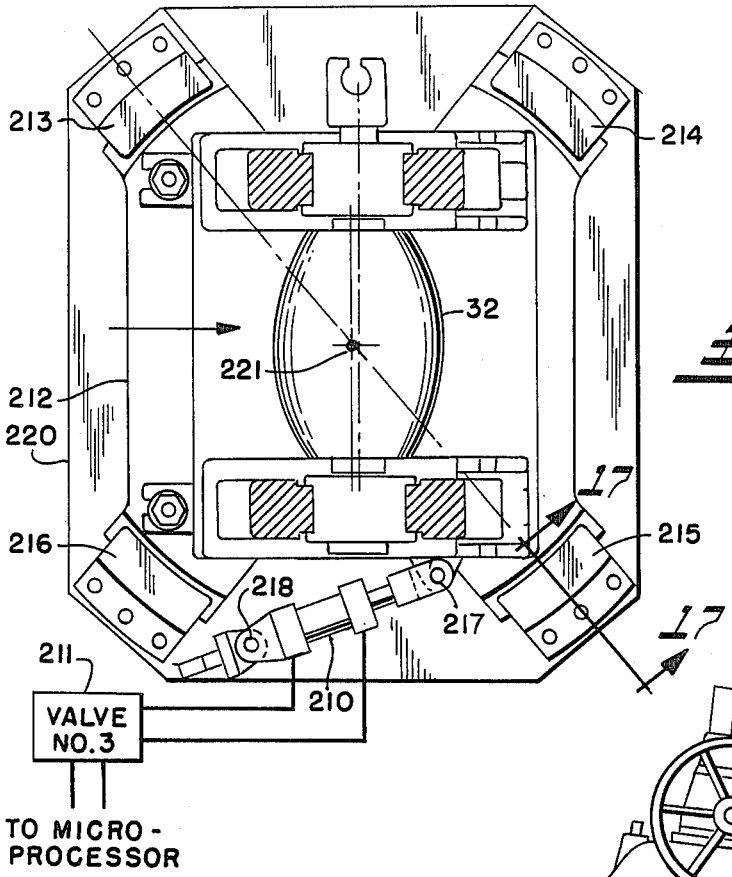
FIG. 16 is a horizontal section taken substantially from the line 16—16 of FIG. 15.
Figure 17:
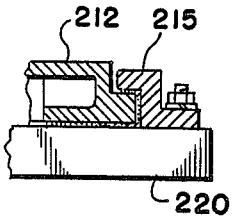
FIG. 17 is a fragmentary vertical section taken from the line 17—17 of FIG. 16.
Figure 15:
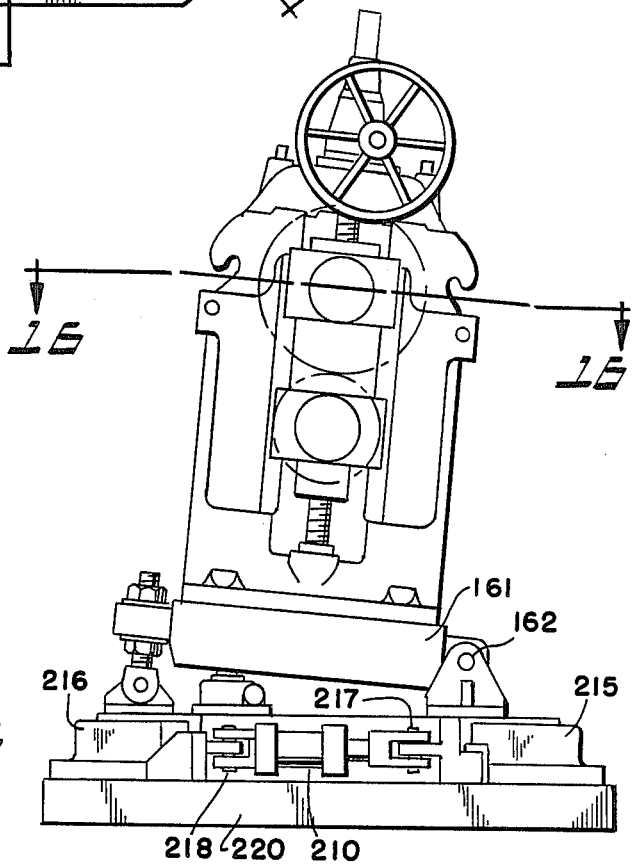
FIG. 15 is a side elevation of another form of the number one breakdown which may be swung about its vertical axis to steer the strip.

The steering of the strip through the number one breakdown stand, or the other breakdown stands for that matter, may also be controlled by in effect steering or skewing the entire breakdown stand. This form of applicant's invention is illustrated in FIGS. 15 through 17.

In such embodiment there is shown the use of a double acting steering piston cylinder assembly 210 which may be controlled by valve 211, again from the microprocessor 125. As seen in FIG. 15 there is illustrated the number one breakdown stand with its tiltable components mounted on a somewhat X-shape steering platform 212 which is in turn supported on base 220 and contained by four segments of circular gib plates with bronze liners indicated at 213, 214, 215, and 216. The rod of the piston cylinder assembly 210 is connected to the steering platform at 217 while the blind end is pivoted at 218 to the base 220. The steering platform 212 is thus pivotally mounted on the base for rotation about the vertical pivot center 221 of the breakdown stand. It should be readily understood that the upper or sub-base may be the skewable base while the lower base is tiltable.

In this embodiment, it will be appreciated that since the entire breakdown stand is now skewable, the edge forming unit will no longer be mounted on the breakdown stand but rather mounted with all its floating and steering provisions directly from the pipe mill base. Alternatively it may be mounted at the entry end of the first cage roller assembly supporting stands. The location of the edge forming assembly in relation to the number one breakdown is, nevertheless, unchanged. It is nonetheless positioned at the close vicinity and exit of the number one breakdown, and prior to the cage roller assembly.

It will of course be appreciated that the primary focus of the present invention is on the butting of the strip edges at the squeeze roll station where the welding is about to take place. Any uneven edge forming will cause the butting of the edges to be not flush, not square to each other, and perhaps fluttering up and down. The lateral creeping movement of the strip in the early forming stages will cause the butting welding seam to be skewed to the front or back rather than stable and at the centerline of the mill, all of which results in a less than desirable product.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

I claim:

1. A forming mill for converting planar strip into closed form for seam welding including a series of successively acting deflecting means for gradually bending the planar strip transverse to its movement through said deflecting means, said deflecting means comprising at least one set of opposed pairs of edge forming rolls, one of each pair being on opposite sides of the longitudinal centerline of the mill, and means mounting said set of opposed pairs of edge forming rolls as a unit for lateral movement with respect to a vertical plane through said centerline of the mill in response to unwanted transverse creep of the strip.

2. A mill as set forth in claim 1 wherein said edge forming rolls are mounted on a plate extending transversely of the mill pivoted to a frame above the centerline of the mill.

3. A mill as set forth in claim 1 including means to adjust each pair of said opposed roll sets so that the roll axes extend at an angle to the longitudinal centerline of the mill but generally normal to the strip edge line.

4. A forming mill for converting planar strip into closed form for seam welding including a series of successively acting deflecting means for gradually bending the planar strip transverse to its movement through said deflecting means, said deflecting means comprising at least one set of opposed pairs of edge forming rolls, one of each pair of said set being at the strip edge line and on opposite sides of the longitudinal centerline of the mill, and means mounting each pair of edge forming rolls for steering about a steering axis extending perpendicular to the axes of said pair of rolls and extending transverse to said pla moved to extend generally normal to said strip edge line during edge forming.

5. A mill as set forth in claim 4 wherein each pair of edge forming rolls is mounted on a plate pivoted above the centerline of the mill.

6. A forming mill for converting planar strip into closed form for seam welding including a series of successively acting deflecting means for gradually bending the planar strip transverse to its movement through said deflecting means, said deflecting means comprising at least one set of opposed pairs of edge forming rolls, one of each pair of said set being at the strip edge line and on opposite sides of the longitudinal centerline of the mill, and means mounting each pair of edge forming rolls for steering about an axis extending in a plane substantially transverse to the strip edge line to counteract creep of the strip transversely of the centerline of the mill.

7. A mill as set forth in claim 6 wherein each pair of edge forming rolls is mounted on a plate pivoted above the centerline of the mill.

8. A mill as set forth in claim 7 including means mounting said each pair of rolls on said plate for steering on a pivot axis extending through the center of pressure of the roll pair.

9. A mill as set forth in claim 8 including a roll housing pivoted on said plate for each pair of rolls, and power means to pivot each housing.

10. A mill as set forth in claim 9 including strip transverse creep sensors upstream and downstream of said set of edge forming rolls, a strip speed sensor, and a microprocessor receiving information from said sensors and in turn controlling said power means.

11. A forming mill for converting planar strip into closed form for seam welding including a series of successively acting deflecting means for gradually bending the planar strip transverse to its movement through said deflecting means, said deflecting means comprising at least one set of opposed pairs of edge forming rolls, one of each pair being on opposite sides of the longitudinal centerline of the mill, and means mounting said set of opposed pairs of edge forming rolls as a unit for lateral movement with respect to a vertical plane through said centerline of the mill in response to transverse creep of the strip, said edge forming rolls being mounted on a plate extending transversely of the mill pivoted to a frame above the centerline of the mill, said plate floating transversely freely.

12. A forming mill for converting planar strip into closed form for seam welding including a series of successively acting deflecting means for gradually bending the planar strip transverse to its movement through said deflecting means, said deflecting means comprising at least one set of opposed pairs of edge forming rolls, one of each pair being on opposite sides of the longitudinal centerline of the mill, and means mounting said set of opposed pairs of edge forming rolls as a unit for lateral movement with respect to a vertical plane through said centerline of the mill in response to transverse creep of the strip, said edge forming rolls being mounted on a plate extending transversely of the mill pivoted to a frame above the centerline of the mill, movement of said plate being assisted by power means extending between said frame and plate.

13. A forming mill for converting planar strip into closed form for seam welding including a series of successively acting deflecting means for gradually bending the planar strip transverse to its movement through said deflecting means, said deflecting means comprising at least one set of opposed pairs of edge forming rolls, one of each pair being on opposite sides of the longitudinal centerline of the mill, and means mounting said set of opposed pairs of edge forming rolls as a unit for lateral movement with respect to a vertical plane through said centerline of the mill in response to transverse creep of the strip, said edge forming rolls being mounted on a plate extending transversely of the mill pivoted to a frame above the centerline of the mill, and including means to center said plate and lock it in centered position with respect to said frame.

14. A mill as set forth in claim 13 wherein said last mentioned means comprises at least one side push cylinder assembly mounted on said frame and a retractable locking pin also mounted on said frame.

15. A forming mill for converting planar strip into closed form for seam welding including a series of successively acting deflecting means for gradually bending the planar strip transverse to its movement through said deflecting means, said deflecting means comprising at least one set of opposed pairs of edge forming rolls, one of each pair being on opposite sides of the longitudinal centerline of the mill, and means mounting said set of opposed pairs of edge forming rolls as a unit for lateral movement with respect to a vertical plane through said centerline of the mill in response to transverse creep of the strip, said edge forming rolls being mounted on a plate extending transversely of the mill pivoted to a frame above the centerline of the mill, and including means mounting each pair of said roll set on said plate for steering on a pivot axis extending through the center of pressure of the roll pair.

16. A mill as set forth in claim 15 including power means mounted on said plate to pivot each pair of said roll set about such steering pivot axis.

17. A mill as set forth in claim 16 wherein each roll set is mounted on a plate bracket pivoted about the centerline of the mill on the same pivot as said plate and adjustably secured to said plate.

18. A mill as set forth in claim 17 including a crankshaft journaled on each plate bracket, and an adjustable link interconnecting said crankshaft and the respective pair of said roll set, said power means being a piston-cylinder assembly mounted on said plate bracket and operative to rotate said crankshaft.

19. A mill as set forth in claim 16 including lateral movement sensors upstream and downstream of each roll set, a strip speed sensor, and a microprocessor receiving information from said sensors and in turn controlling said power means.

20. A forming mill for converting planar strip into closed form for seam welding including a series of successively acting deflecting means for gradually bending the planar strip transverse to its movement through said deflecting means, said deflecting means comprising at least one set of opposed pairs of edge forming rolls, one of each pair of said set being at the strip edge line and on opposite sides of the longitudinal centerline of the mill, means mounting each pair of edge forming rolls for steering so that the axis of said rolls may be moved to extend generally normal to said strip edge line, each pair of edge forming rolls being mounted on a plate pivoted above the centerline of the mill, and means mounting said each pair of rolls on said plate for steering on a pivot axis extending through the center of pressure of the roll pair.

21. A mill as set forth in claim 20 including a roll housing pivoted on said plate for each pair of rolls, and power means to pivot each housing.

* * * * *